US008538758B2

(12) United States Patent
Nakamae

(10) Patent No.: US 8,538,758 B2
(45) Date of Patent: Sep. 17, 2013

(54) ELECTRONIC APPARATUS

(75) Inventor: Midori Nakamae, Akishima (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 49 days.

(21) Appl. No.: 13/241,018

(22) Filed: Sep. 22, 2011

(65) Prior Publication Data

US 2012/0197645 A1 Aug. 2, 2012

(30) Foreign Application Priority Data

Jan. 31, 2011 (JP) ..... 2011-019225

(51) Int. Cl.
*G10L 13/08* (2013.01)
*G10L 13/06* (2013.01)
*G10L 21/00* (2013.01)

(52) U.S. Cl.
USPC ..... 704/260; 704/267; 704/270

(58) Field of Classification Search
None
See application file for complete search history.

(56) References Cited

U.S. PATENT DOCUMENTS

| | | | | |
|---|---|---|---|---|
| 5,396,577 | A * | 3/1995 | Oikawa et al. | 704/260 |
| 5,749,071 | A * | 5/1998 | Silverman | 704/260 |
| 5,752,228 | A * | 5/1998 | Yumura et al. | 704/260 |
| 5,991,724 | A * | 11/1999 | Kojima et al. | 704/266 |
| 6,205,427 | B1 * | 3/2001 | Itoh et al. | 704/260 |
| 7,065,485 | B1 * | 6/2006 | Chong-White et al. | 704/208 |
| 7,742,920 | B2 * | 6/2010 | Nagae et al. | 704/267 |
| 8,073,695 | B1 * | 12/2011 | Hendricks et al. | 704/260 |
| 8,145,497 | B2 * | 3/2012 | Ahn et al. | 704/278 |
| 2002/0133521 | A1 * | 9/2002 | Campbell et al. | 707/526 |
| 2003/0014253 | A1 * | 1/2003 | Walsh | 704/260 |
| 2006/0020890 | A1 * | 1/2006 | Kroll et al. | 715/716 |
| 2006/0106618 | A1 * | 5/2006 | Racovolis et al. | 704/277 |
| 2011/0047495 | A1 * | 2/2011 | Hendricks | 715/770 |
| 2011/0320950 | A1 * | 12/2011 | Rajput et al. | 715/728 |

FOREIGN PATENT DOCUMENTS

| | | |
|---|---|---|
| JP | 11-073298 | 3/1999 |
| JP | 2001-343989 | 12/2001 |
| JP | 2003-016012 | 1/2003 |
| JP | 2003-131700 | 5/2003 |
| JP | 2003-208192 | 7/2003 |
| JP | 2003-263200 | 9/2003 |
| JP | 2003-302990 | 10/2003 |
| JP | 2004-192653 | 7/2004 |
| JP | 2005-106844 | 4/2005 |

(Continued)

OTHER PUBLICATIONS

Japanese Patent Application No. 2010-244530; Notice of Reasons for Rejection; Mailed Sep. 6, 2011 (with English translation).

(Continued)

*Primary Examiner* — Brian Albertalli
(74) *Attorney, Agent, or Firm* — Blakely, Sokoloff, Taylor & Zafman LLP

(57) ABSTRACT

An electronic apparatus includes a communication module, a storage module, a manipulation module, voice output control module, and a control module. The communication module receives book data delivered externally. The storage module stores the received book data. The manipulation module converts a manipulation of a user into an electrical signal. The voice output control module reproduces, as a voice, the book data based on the manipulation while controlling the reproduction speed of the voice. The control module determines a part that is important to the user, stores, in the storage module, a position of voice reproduction of the book data, and synchronizes the position of the voice reproduction with a reproduction position in the book data.

6 Claims, 7 Drawing Sheets

(56) References Cited

FOREIGN PATENT DOCUMENTS

| | | |
|---|---|---|
| JP | 2008-048297 | 2/2008 |
| JP | 2008-096482 | 4/2008 |
| JP | 2010-066422 | 3/2010 |
| JP | 2010-085727 | 4/2010 |
| WO | WO 2011-135770 | 11/2011 |

OTHER PUBLICATIONS

Japanese Patent Application No. 2011-019225; Notice of Reasons for Rejection; Mailed Jan. 24, 2012 (with English translation).

* cited by examiner (FIG. 6 Continued)

ELECTRONIC APPARATUS

CROSS REFERENCE TO RELATED APPLICATION(S)

The present disclosure relates to the subject matters contained in Japanese Patent Application No. 2011-019225 filed on Jan. 31, 2011, which are incorporated herein by reference in its entirety.

FIELD

An exemplary embodiment of the present invention relates to an electronic apparatus such as an electronic book voice reproduction system in which the reproduction speed is adjusted automatically.

BACKGROUND

In electronic book voice reproduction systems in which the reproduction speed is adjusted, users are required to switch the voice reproduction speed manually and cumbersome manipulations are necessary. Also, users tend to merely hear a reproduction voice monotonously without remembering much of its contents.

One countermeasure against the above is a restrictive system in which the reproduction speed of educational content data which contains difficulty information is controlled (see JP-A-2008-96482, for instance). This is a network learning assist system in which the voice reproduction speed is determined dynamically based on difficulty in a particular interval of video-audio data and proficiency level of a learner.

However, it is desired to provide a technique for controlling the voice reproduction speed that is more suitable for general use.

BRIEF DESCRIPTION OF THE DRAWINGS

A general configuration that implements the various features of the invention will be described with reference to the drawings. The drawings and the associated descriptions are provided to illustrate embodiments of the invention and should not limit the scope of the invention.

DETAILED DESCRIPTION OF THE EMBODIMENTS

According to an exemplary embodiment of the invention, there is provided an electronic apparatus including a communication module, a storage module, a manipulation module, voice output control module, and a control module. The communication module is configured to receive book data delivered externally. The storage module is configured to store the received book data. The manipulation module is configured to convert a manipulation of a user into an electrical signal. The voice output control module is configured to reproduce, as a voice, the book data stored in the storage module based on the manipulation while controlling the reproduction speed of the voice. The control module is configured to: determine a part that is important to the user; store, in the storage module, a position of voice reproduction of the book data by the voice output control module; and synchronize the position of the voice reproduction with a reproduction position in the book data.

An exemplary embodiment of the present invention will be hereinafter described with reference to FIGS. 1 to 6.

In recent years, electronic book display systems are widely used which download electronized book data (e.g., electronic data of technical books, novels, etc.) from a prescribed server by a communication over the Internet or the like and display those book data on a screen. In the following, book data to be displayed on a screen will be referred to simply as an "electronic book." Techniques for reading an electronic book aloud using a voice synthesis technique and audio books produced by converting ordinary books into audio data are also widely used. Whereas many of previous audio books were directed to visually impaired persons, in recent years audio books of self-enlightenment books and business books have come to be sold increasingly. And demand for audio books from people who want to study efficiently in commuter trains and cars and during walks is increasing. The embodiment relates to a voice reproduction system which is most suitable for the user to learn the contents of an electronic book more efficiently and effectively.

An electronic apparatus according to the embodiment having such functions will be described below.

Figure 1:
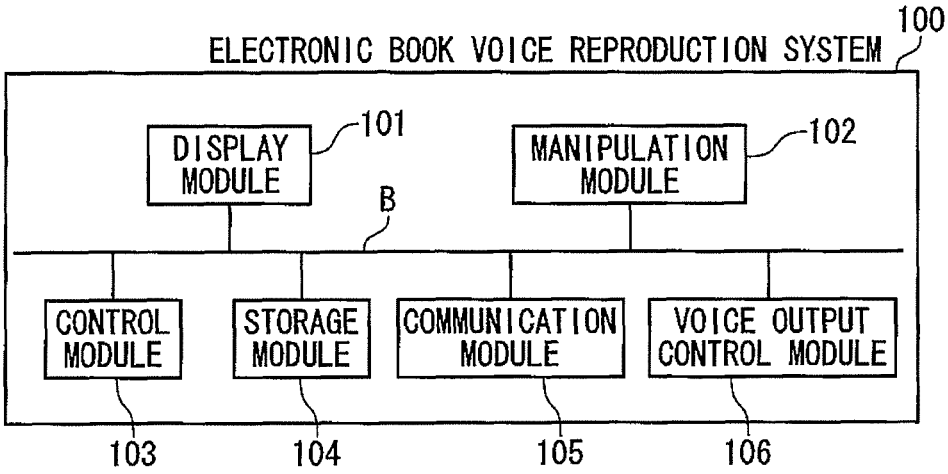
FIG. 1 is an exemplary block diagram showing configuration of an electronic book voice reproduction system according to an exemplary embodiment of the present invention.

As shown in FIG. 1, an electronic book voice reproduction system 100 according to the embodiment is configured of a control module 103, a display module 101, a manipulation module 102, a storage module 104, a communication module 105, and a voice output control module 106.

The control module 103 is a microcomputer. The control module 103 is connected to the display module 101, the manipulation module 102, the storage module 104, the communication module 105, and the voice output control module 106 via a common bus B and exchanges signals with them.

The display module 101 is a touch screen 210, which will be described later with reference to FIG. 2. A text to be voice-reproduced by the electronic book voice reproduction system 100, a figure, or a picture for setting of the electronic book voice reproduction system 100 is displayed on the display module 101 according to a signal that is supplied from the control module 103.

Figure 2:
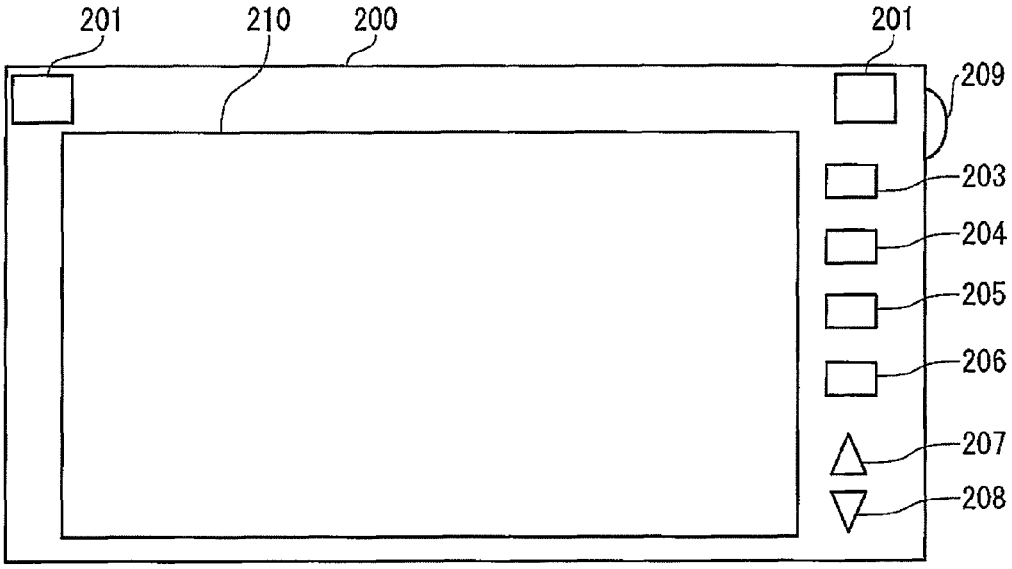
FIG. 2 shows an example display module and manipulation module used in the embodiment.

The manipulation module 102 is provided with various manipulation buttons shown in FIG. 2 that are necessary for electronic book browsing manipulations. Examples of the manipulation buttons are a power button 203 for powering on/off the electronic book voice reproduction system 100, a volume dial 209 for adjusting the volume of a voice that is output from the voice output control module, a voice reproduction start button 204, a page-up button 207, a page-down button 208, a pause button 205, and a voice reproduction stop button 206.

The storage module 104, which is, for example, a nonvolatile memory such as a flash memory, is stored with plural electronic book data (e.g., text data) and an electronic book application for displaying and voice-reproducing an electronic book. As described later, electronic book data is written to the storage module 104 by the control module 103 via the communication module 105.

The communication module 105 performs a communication with a server which distributes electronic book data, under the control of the control module 103. In the embodiment, it is assumed that the communication module 105 is connected, for communication, to an electronic book distribution server via the Internet.

The voice output control module 106 receives electronic book data from the storage module 104 and outputs, from speakers 201 (see FIG. 2), a voice by reading the electronic book data aloud. As described later, the voice output control module 106 outputs the voice while changing the voice reproduction speed, the volume, etc. according to an instruction from the control module 103. The voice that is output by reading the electronic book data aloud may be produced either based on voice data that was prepared by a provider of the electronic book or by converting text information into an audio signal using a voice synthesis technique.

FIG. 2 shows examples of the display module 101 and the manipulation module 102 which are used for implementing the embodiment. The following description will be made with incorporation of the steps of a process shown in a flowchart of FIG. 6.

When the user presses the power button 203 of an electronic book terminal 200 (the electronic book voice reproduction system 100), the electronic book terminal 200 is powered on (step S1001). The electronic book application is activated and a list of electronic books stored in the storage module 104 is displayed on the touch screen 210 (step S1002).

In the embodiment, the electronic books stored in the storage module 104 are ones that were purchased by the user over the Internet via the communication module 105. The user selects an electronic book he or she wants to read from the list of electronic books displayed on the touch screen 210 and touches it with his or her finger, whereupon the electronic book application recognizes the selected electronic book based on coordinate information of the position, touched by the user, on the touch screen 102 and displays a text of the selected electronic book on the touch screen 102 (step S1003).

Then, learning plans are displayed on the touch screen 102. For example, in the embodiment, the following five learning plans are prepared. Although in the embodiment the following learning plans are prepared in advance in the electronic book application, learning plans may be prepared by the producer of each electronic book.

(1) Plan A recommended by a knowledgeable person (2) Plan B recommended by a knowledgeable person (3) Plan C recommended by a knowledgeable person (4) Automatic, leaving-up plan (5) Setting of only a word and/or a time The following menu item is prepared for a case of selecting no learning plan:

(6) No setting

Figure 3:
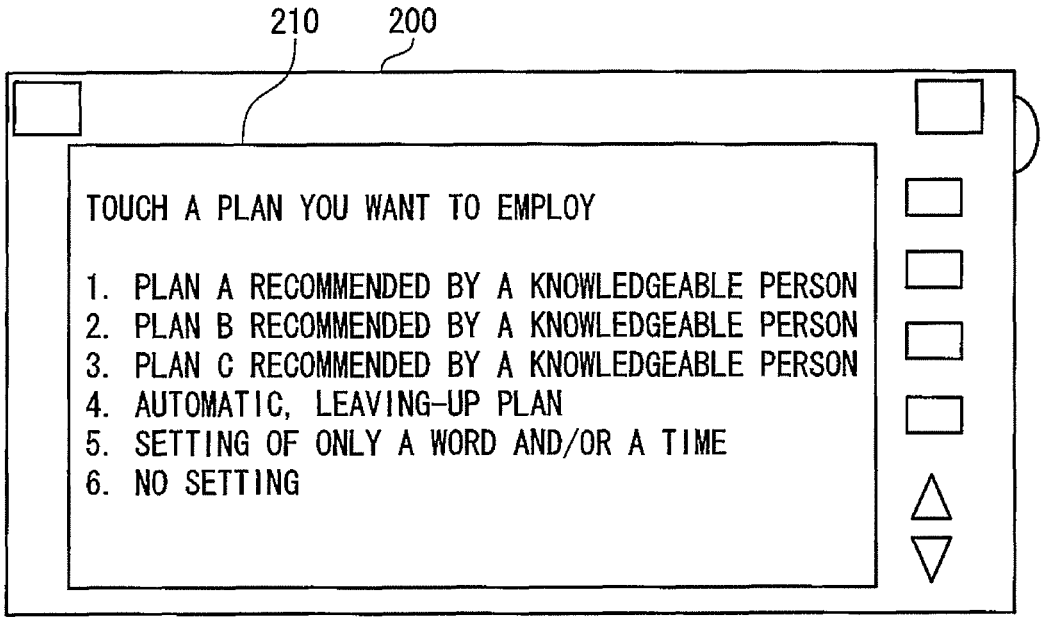
FIG. 3 shows an example picture for selection of a learning plan which is displayed in the embodiment.

FIG. 3 shows a picture for selection of a learning plan which is displayed by the electronic book application. The user selects one he or she wants to employ from the learning plans displayed on the touch screen 210 and touches it with his or her finger. The electronic book application recognizes the selected learning plan based on coordinate information of the position, touched by the user, on the touch screen 210 (step S1004).

In the embodiment, assume that the user selects "(4) automatic, leaving-up plan." In this case, a test that was prepared in advance is carried out, parts that are important to the user are determined based on test results, and a learning plan is created so that those parts will be reproduced. The producer of each electronic book prepares a test for it in advance. After selecting "(4) automatic, leaving-up plan," the user answers test problems. Based on the answers, the electronic book application finds important parts that the user needs to learn in a concentrated manner. An example manner of finding important parts from test results is as follows:

(A) Three problems are prepared for each of 10 chapters, for example, that constitute an electronic book.

(B) When two or three problems for a chapter are not answered correctly, it is determined that the user does not understand the contents of that chapter and hence needs to learn that chapter in a concentrated manner.

(C) When two problems for a chapter are answered correctly, it is determined that the user understands the contents of that chapter well and a short learning time is allocated to it.

(D) When all the three problems for a chapter are answered correctly, it is determined that the user understands the contents of that chapter completely and the electronic book application does not have the user learn it.

In the embodiment, assume that the user cannot correctly answer all the three problems of chapters 3, 4, 7, and 9 of the 10 chapters of the electronic book. These chapters are thus employed as reproduction parts (step S1021). Since two problems are not answered correctly for chapters 3 and 9, chapters 3 and 9 are determined important to the user. Since two problems are answered correctly for chapters 4 and 7, high-speed learning is employed for chapters 4 and 7 (step S1022). Although in the above example important parts are determined on a chapter-by-chapter basis, important parts may be determined in smaller units (e.g., in units of a paragraph).

Figure 4:
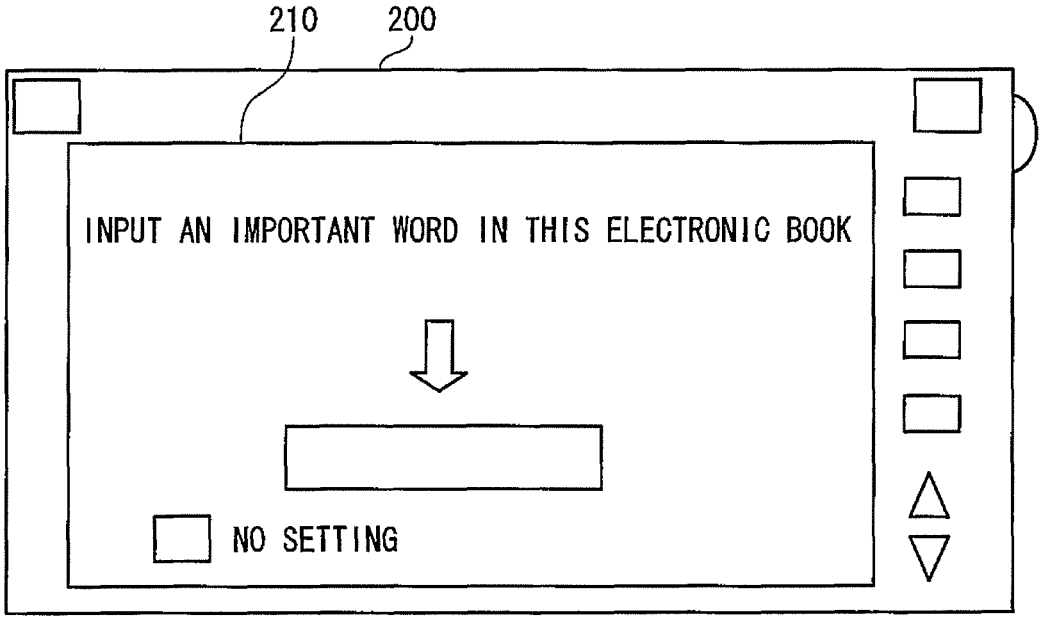
FIG. 4 shows an example picture for setting of an important word for learning in the embodiment.

Then, the user sets an important word using a software keyboard being displayed on the touch screen 210 (step S1005). FIG. 4 shows an example picture. When there is no important word, the user touches a check box "no setting" being displayed on the touch screen 210 with his or her finger. In this case, it is not necessary to perform the following step S1006.

Figure 5:
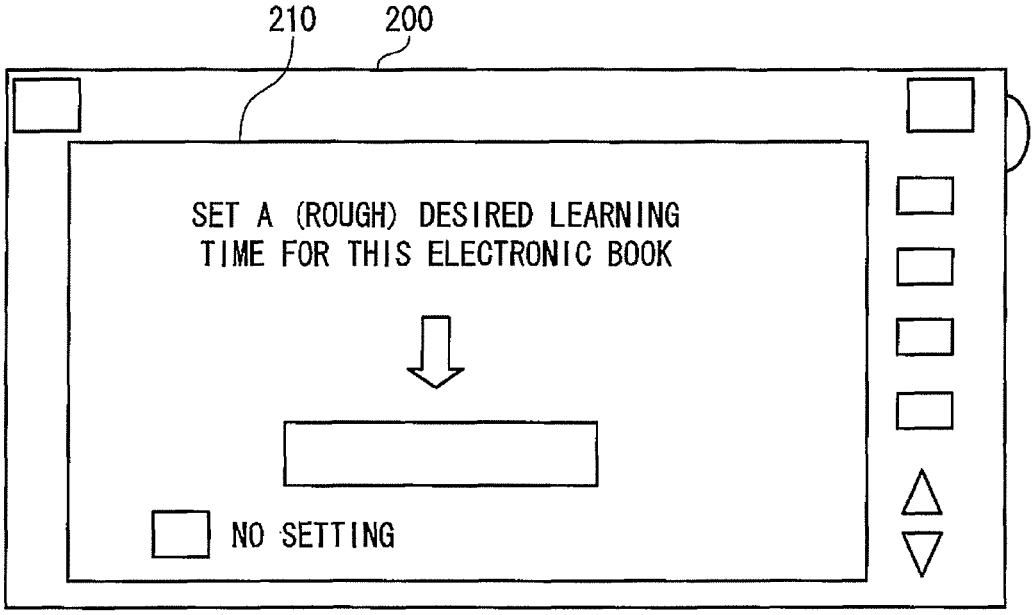
FIG. 5 shows an example picture for setting of a learning time in the embodiment.
Figure 6:
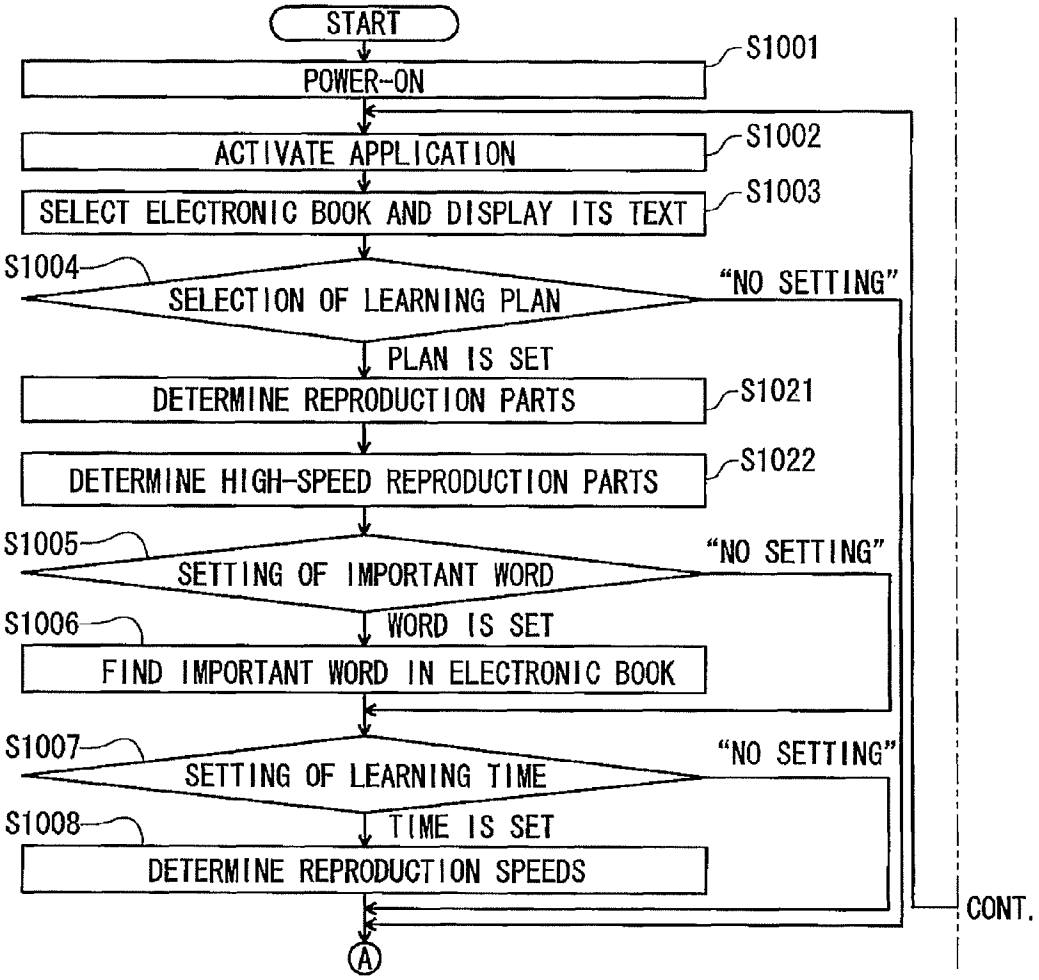
FIG. 6 is an exemplary flowchart showing a process according to the embodiment.
Figure 6:
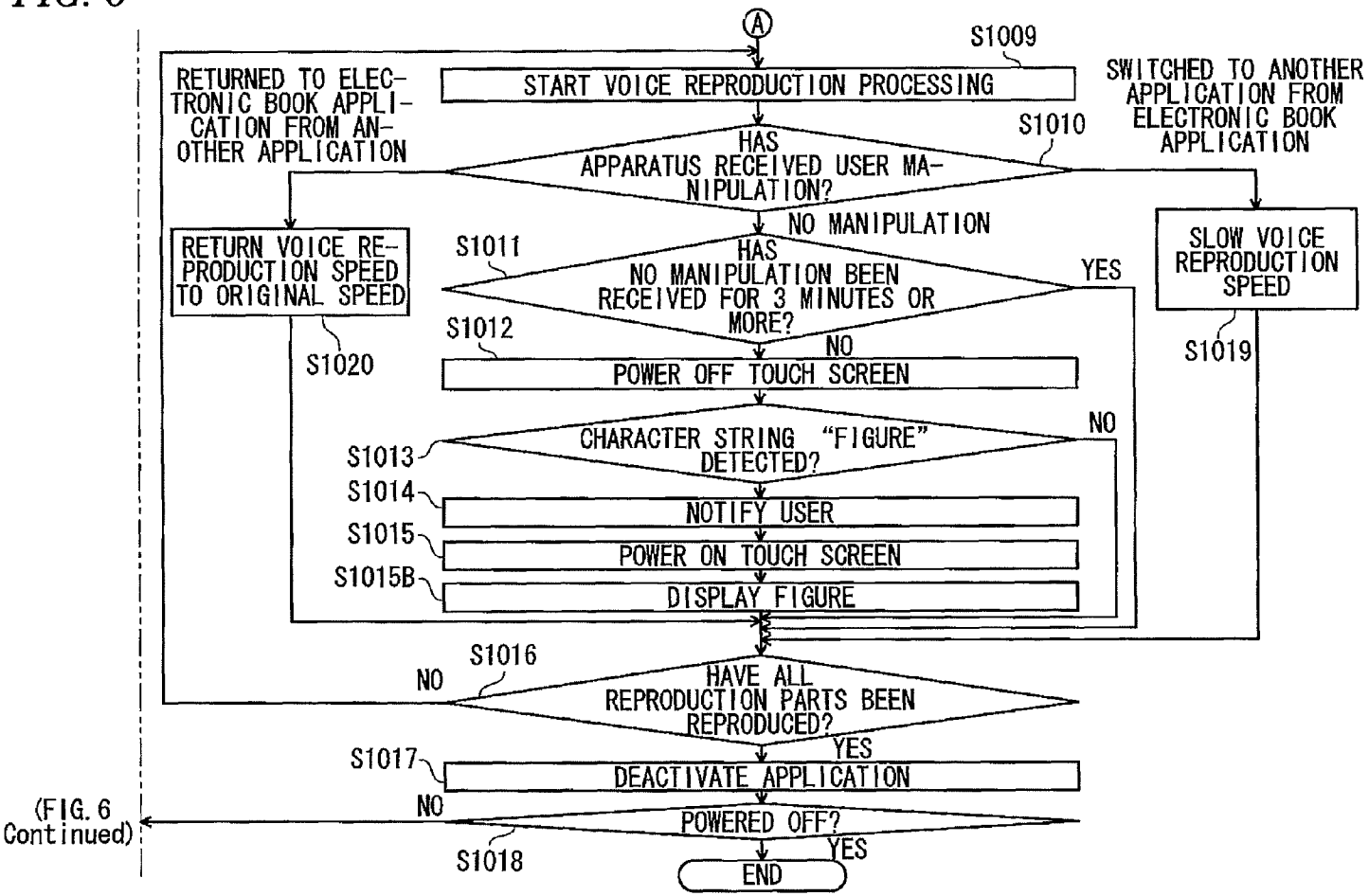

In the embodiment, assume that the user inputs "test" as an important word. The electronic book application divides the text that was displayed on the touch screen 210 into words in advance by a morphological analysis, and finds, in the electronic book, the word that has been input by the user (step S1006). Then, the user sets a learning time (reading end time) using a software keyboard being displayed on the touch screen 210 (step S1007). FIG. 5 shows an example picture. When the user does not want to set a learning time, the user touches a check box "no setting" being displayed on the touch screen 210 with his or her finger. In this case, it is not necessary to perform the following step S1008.

In the embodiment, assume that a learning time of about 2 hours has been set. The number of characters contained in the electronic book is calculated in advance, and a reading time per character is calculated so that the electronic book can be read aloud in 2 hours (step S1008). Although the actual reading time depends on the character type (Chinese character or hiragana) and the word to some extent, such factors are disregarded in calculating a reading time per character. For example, in the embodiment, assume that chapters 3 and 9 contain 10,000 characters in total and chapters 4 and 7 contain 10,000 characters in total. To complete reading in 2 hours (7,200 seconds), it is necessary to read chapters 3 and 9 at a speed of three characters per second and to read chapters 4 and 7 at a speed of five characters per second (high-speed learning).

Thus, the various kinds of setting have been completed. Voice reproduction processing is started as soon as the user gives a reproduction instruction (step S1009).

The voice output control module 106 reproduces the chapters at the respective reproduction speeds that were set in the above-described manner. A special effect may be added in reproducing the parts that are important to the user. Examples of the special effect are an effect sound, attraction of attention by a voice, and vibration. In the embodiment, reproduction is started at chapter 3. Since chapter 3 is important to the user, such a message as "This is an important part" may be reproduced immediately before reproduction of chapter 3.

The control module 103 always stores the voice reproduction position and the electronic book text position in the storage module 104. To allow the user to easily recognize the current reading position, a mark may be added at the current reproduction position in the electronic book text being displayed on the touch screen 210.

When the word "test" which was set as an important word by the user is found in the voice reproduction processing, the voice output control module 106 slows the reproduction speed according to an instruction from the control module 103. In the embodiment, while usually the electronic book is reproduced at the speed of three or five characters per second, the important character string is reproduced at a speed of two characters per second. The important word may be reproduced at an increased volume or a special effect may be added immediately before reproduction of the important word.

Next, a description will be made of steps which are performed during voice reproduction.

Assume that a mail is received via the communication module 105 while the user is learning using the system 100. Triggered by this event, the user switches the picture displayed on the touch screen 210 from the text picture of the electronic book application to a picture of a mail application. The voice reproduction continues unless the user presses the pause button 205 or the voice reproduction stop button 206. In such an event, the user is caused to learn while reading the mail, as a result of which the user would lose and could not understand the current reproduction part of the electronic book satisfactorily. In view of this, the control module 103 determines, based on a user manipulation, that the control module 103 has made switching from the electronic book application to another application (step S1010) and the voice output control module 106 slows the reproduction speed (step S1019).

For example, when the control module 103 determines that the picture displayed on the touch screen 210 has been switched from the text picture of the electronic book application to a picture of another application, the voice output control module 106 decrease the number of reproduction characters per second by one. For example, when the electronic book has been reproduced at a speed of three characters per second, the reproduction speed is decreased to two characters per second.

When the user made, in advance, a setting that the reproduction speed need not be changed, step S1019 may be skipped.

When determining that the user is listening to the reproduction voice of the electronic book but is not viewing the text, control module 103 powers off the touch screen 210 (step S1012). On the other hand, the voice reproduction is continued. When finding, during the reproduction, a passage or a character string that explains a figure in the electronic book, the control module 103 urges the user to view the figure.

In the embodiment, when the user has not made any manipulation through the manipulation module 102 for 3 minutes during the voice reproduction by the electronic book application (S1011: no), the control module 103 powers off the touch screen 210. The electronic book application finds a character string "figure" in advance by a morphological analysis (S1013: yes), the voice output control module 106 notifies the user of upcoming arrival of the figure by adding an effect sound or a voice that would attract attention of the user immediately before reproduction of the character string "figure" (step S1014). Then, the touch screen 210 is powered on (step S1015) and a page including the figure of the electronic book is displayed (step S1015B). This allows the user to view the figure quickly.

However, when the user made, in advance, a setting that it is not necessary to urge the user to view a figure or when the user is in a situation that he or she cannot make a manipulation (e.g., the terminal 200 is in a drive mode), steps S1013 to S1015B may be skipped.

The electronic book application performs the above steps repeatedly until all the reproduction parts of the electronic book are reproduced or the user powers off the system 100 (step S1016). The electronic book application is deactivated when all the reproduction parts of the electronic book have been reproduced (step S1017). When the user presses the power button 203 of the electronic book terminal 200, the electronic book terminal 200 is powered off. If not, the process returns to step S1002 (step S1018).

Modifications to the embodiment will be described below.

In the embodiment, electronic book data is received from an electronic book server over the Internet. Alternatively, electronic books that were stored in the electronic book terminal 200 when it was manufactured by a manufacturer or electronic books that are stored in an external medium such as an SD card may be used.

Although in the embodiment the voice output control module 106 is equipped with the speakers 201, it may be equipped with earphones to output a voice through them.

Although in the embodiment the degree of importance to the user is determined based on test results, the method for determining the degree of importance is not limited to it. For example, when a plan recommended by a knowledgeable person is selected, the knowledgeable person may set important parts for the user in advance and the reading order, for instance, may be changed. Reproduction parts may be determined based on preference information, or a purchase history or search history of the user. For example, when the user has already learned an electronic book of the same genre as an electronic book to be learned, a first half, for example, may be skipped. Although in the embodiment the producer of each electronic book prepares a test in advance, the system 100 may generate a test automatically for each electronic book.

Although in the embodiment the reproduction speed is changed in reproducing a part (word) that is important to the user, the method for emphasizing an important part is not limited to it. For example, the reproduction volume, the kind (tone) of a reproduced voice, or the intonation of a reproduced voice may be changed.

Although in the embodiment the touch screen 210 is powered off when no user manipulation has been received for 3 minutes, the touch screen power control method is not limited to it. For example, the user may be allowed to freely set the time for power-off of the touch screen 210.

As described above, in the embodiment, since the voice output control module 106 is added, the voice reproduction speed is controlled, whereby parts that are important to the user are reproduced in an emphasized manner. In the electronic book voice reproduction system 100 according to the embodiment, the voice reproduction speed is controlled automatically according to the degree of importance that is specified by the user or a knowledgeable person. The means for determining the degree of understanding of the user, the means for calculating a reproduction speed based on the degree of understanding, and the means for controlling the voice reproduction speed are provided, whereby the time that the user is to consume to learn an electronic book can be shortened, which is convenient to the user.

In the embodiment, in voice-reproducing a general-purpose electronic book using a voice synthesis technique, reproduction parts and the reproduction speed are changed automatically, which provides the following advantages. The means for controlling the voice reproduction speed and thereby reproducing parts that are important to the user in an emphasized manner increases the convenience of learning of an electronic book and allows the user to learn it efficiently. The means for reproducing parts that are important to the user in an emphasized manner allows the user to understand the contents of an electronic book more efficiently.

The means for changing the reproduction speed when detecting that the user has made a manipulation that does not relate to voice reproduction or display of electronic book data prevents the user from catching a reproduced voice even while doing another thing and thereby allows the user to learn the contents of an electronic book efficiently.

The means for notifying the user that a part to be reproduced soon includes an illustration or a figure makes it unnecessary for the user to view the screen all the time, that is, allows the user to view the screen only when necessary, which allows the user to learn the contents of an electronic book more efficiently.

The invention is not limited to the above embodiment, and can be practiced so as to be modified in various manners without departing from the spirit and scope of the invention.

And various inventions can be conceived by properly combining plural constituent elements disclosed in the embodiment. For example, several ones of the constituent elements of the embodiment may be omitted.

What is claimed is:

1. An electronic apparatus comprising:

a storage module configured to store book data;

a manipulation module configured to convert a manipulation of a user into an electrical signal;

a voice output control module configured to reproduce a voice by reading the book data in the storage module based on the manipulation while changing the reproduction speed into an instructed speed; and a control module configured to control the voice output control module to change the reproduction speed of the book data into a low speed when the voice output control module reproduces the voice of the book data while changing a reproduction speed of an important part where the user has previously specified among the book data and performing a manipulation other than reproduction of the book data without stopping the voice reproducing operation is detected.

2. The electronic apparatus of claim 1, wherein the control module is configured to store, in the storage module, a position of voice reproduction of the book data by the voice output control module, and to synchronize the position of the voice reproduction with a reproduction position in the book data.

3. The electronic apparatus of claim 1, wherein a reproduction part in the book data is determined by calculating, in the control module, a part that is important to the user or by reading, from the storage module, an important part specified in a plan that was set by a producer of the book data in advance.

4. The electronic apparatus of claim 1, wherein the manipulation module is configured to detect a speed or a reading end time specified by the user, wherein the control module is configured to determine the reproduction speed of the voice on a reproduction part of the book data based on a plan recommended by a producer of the book data in advance or a degree of importance to the user, and wherein the reproduction speed of the voice or volume is changed or an effect sound or a voice for attracting attention is added.

5. The electronic apparatus of claim 1, wherein when the user sets a particular word, the particular word is reproduced at a low speed or a changed volume or the particular word is reproduced with an effect sound or a voice for attracting attention added so that the particular word is reproduced in an emphasized manner.

6. The electronic apparatus of claim 1, further comprising a display module configured to display the book data, wherein when it is determined that the user is not viewing the display module during voice reproduction of the book data and that a part to be reproduced includes an illustration or a figure, the user is urged to view the display module and the illustration or the figure is displayed at the display module.

* * * * *